US008521045B2

(12) United States Patent
Inada et al.

(10) Patent No.: US 8,521,045 B2
(45) Date of Patent: Aug. 27, 2013

(54) IMAGE FORMING APPARATUS AND IMAGE DENSITY CORRECTION METHOD THEREFOR

(75) Inventors: Yasuyuki Inada, Toyohashi (JP); Katsuyuki Hirata, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 258 days.

(21) Appl. No.: 13/160,095

(22) Filed: Jun. 14, 2011

(65) Prior Publication Data

US 2011/0311245 A1 Dec. 22, 2011

(30) Foreign Application Priority Data

Jun. 22, 2010 (JP) ..... 2010-141323

(51) Int. Cl.
*G03G 13/00* (2006.01)
*G03G 13/14* (2006.01)

(52) U.S. Cl.
USPC ..... 399/46; 399/11; 399/31

(58) Field of Classification Search
USPC ..... 399/11, 31, 46, 47, 49, 67, 72
See application file for complete search history.

(56) References Cited

U.S. PATENT DOCUMENTS

| | | | | |
|---|---|---|---|---|
| 7,068,957 | B2 | 6/2006 | Shimura et al. | |
| 7,251,423 | B2 | 7/2007 | Shimura et al. | |
| 7,824,760 | B2 | 11/2010 | Mochizuki et al. | |
| 2003/0091357 | A1 * | 5/2003 | Maebashi et al. | 399/49 |
| 2009/0087207 | A1 * | 4/2009 | Iida et al. | 399/74 |

FOREIGN PATENT DOCUMENTS

| | | | |
|---|---|---|---|
| JP | 2004-102239 | A | 4/2004 |
| JP | 2005-316193 | A | 11/2005 |
| JP | 2007-212921 | A | 8/2007 |
| JP | 2008-292925 | A | 12/2008 |

OTHER PUBLICATIONS

Office Action (Notification of Reasons for Refusal) dated Apr. 24, 2012, issued in corresponding Japanese Patent Application No. 2010-141323, and an English Translation thereof (with Verification of Translation). (6 pages).

* cited by examiner

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image forming apparatus includes: sensor detecting light intensity and output voltage based on the light intensity; data acquisition part setting reference voltages for the sensor to detect light intensity of bare surface of intermediate transfer member, acquiring, at set reference voltage, voltage output by the sensor on the bare surface as detection data; storage storing the detection data corresponding to the reference voltages; judgment part judging whether to perform image density correction processing; voltage calibration part adjusting output level at light intensity detection; density acquisition part forming toner pattern, and acquiring density data of the toner pattern by causing the sensor having adjusted output level to detect its light intensity; density data correction part reading one piece of detection data referring to output level, and correcting the density data based on the detection data; and image density correction part performing the processing based on the density data.

19 Claims, 13 Drawing Sheets

FIG. 12

Table for bare surface profile data

| Sampling number | 1 | 2 | 3 | 4 | 5 | 6 | 7 | 8 | |
|---|---|---|---|---|---|---|---|---|---|
| V1' | a1 | a2 | a3 | a4 | a5 | a6 | a7 | a8 | |
| V2' | b1 | b2 | b3 | b4 | b5 | b6 | b7 | b8 | |
| V3' | c1 | c2 | c3 | c4 | c5 | c6 | c7 | c8 | |

IMAGE FORMING APPARATUS AND IMAGE DENSITY CORRECTION METHOD THEREFOR

This application is based on application No. 2010-141323 filed in Japan, the content of which is hereby incorporated by reference.

BACKGROUND OF THE INVENTION (1) Field of the Invention

The present invention relates to an image forming apparatus, and particularly to an image density correction technology for correcting density and tint of a reproduced image in the image forming apparatus.

(2) Description of the Related Art

An image forming apparatus employing an electrophotographic system has the following structure. A surface of a photosensitive member is uniformly charged by a charger, and the charged surface of the photosensitive member is scanned by laser light to form an electrostatic latent image. Then, toner is supplied to the electrostatic latent image by a developer to develop the electrostatic latent image. A toner image resulting from the above process is primarily transferred onto an intermediate transfer member such as an intermediate transfer belt, and then is secondarily transferred onto a recording sheet to form an image.

By the way, an amount of toner attached to the photosensitive member and a transfer rate of toner onto the intermediate transfer belt are greatly influenced by an environment of the image forming apparatus such as temperature and humidity, variation in charging characteristics due to deterioration of toner over time, and so on. This sometimes changes the density of a reproduced image, and particularly changes the tint of the reproduced image of color image to the great extent.

In response, control for automatically correcting the image density has been conventionally performed, as part of image stabilization processing.

The following describes the details of such processing. A toner pattern is formed on the intermediate transfer belt in accordance with a predetermined timing. The formed toner pattern is irradiated with light from a light source, and its reflected light, that is specular reflected light or diffuse reflected light, is detected by a photoelectric sensor. Hereinafter, detection on tonner patterns means detection of intensity of light reflected from toner patterns. When a toner density obtained based on a detected value differs from a desired density, the control is performed such that a reproduced image has an appropriate density. The control is performed by controlling a charge potential by the charger on a surface of the photosensitive member, output of laser light, developing bias applied to a developing roller, gradation conversion curve (γ curve), and so on, and is hereinafter referred to as "image density correction processing".

An intermediate transfer belt included in an image forming apparatus is generally endless, and is molded by injection-molding or centrifugal-molding. Demolding process results in linear scratches (hereinafter referred to as "manufacturing-derived scratches") on a surface of the intermediate transfer belt.

In response, process of removing such manufacturing-derived scratches on the surface of the intermediate transfer belt has been performed (hereinafter referred to as "shape correction process"). However, since this shape correction process increases the manufacturing costs, and sometimes decreases the manufacturing yield, there is recently a demand for omission of the shape correction process upon request for cost reduction.

If the shape correction process is omitted, show-through of the manufacturing derived scratches appears on a toner pattern formed in the above image density correction processing, and this deteriorates the detection precision of toner density. Particularly when detection is performed on a half-tone toner pattern, there occurs markedly such a negative effect caused by the show-through. This might make it difficult to perform precise image density correction processing.

On the other hand, a time required for the image density correction processing is desirably as short as possible, in order to avoid delay of outputting the first page when the image density correction processing is performed immediately before a print job is executed, or in other case, in order to respond to a demand for reducing downtime.

SUMMARY OF THE INVENTION

One aspect of the present invention is an image forming apparatus that primarily transfers a toner image formed on an image carrier onto an intermediate transfer member, and secondarily transfers the toner image onto a recording sheet to form an image, the image forming apparatus comprising: a sensor operable to detect intensity of light, and output a voltage in accordance with the detected intensity of light; a detection data acquisition part operable to (i) set a plurality of reference voltages, which are each to be referred to when the sensor detects intensity of light reflected from a bare surface of the intermediate transfer member onto which a toner image has not yet been transferred, and (ii) acquire, at each set reference voltage, a voltage output by the sensor with respect to a predetermined area on the bare surface in a circumferential direction of the intermediate transfer member, as a piece of detection data; a detection data storage operable to store therein the acquired pieces of detection data in one-to-one correspondence with the reference voltages; a judgment part operable to judge whether to perform image density correction processing of correcting a density of a tonner image to be formed; an output level calibration part operable, when the judgment part judges affirmatively, to adjust an output level of the sensor at the detection of the intensity of light reflected from the bare surface for calibration; a density data acquisition part operable to form a toner pattern within the predetermined area, and acquire density data of the toner pattern by causing the sensor, whose output level has been adjusted, to detect intensity of light reflected from the toner pattern; a density data correction part operable to read one of the pieces of detection data from the detection data storage with reference to the adjusted output level, and correct the acquired density data based on the read piece of detection data; and an image density correction part operable to perform the image density correction processing based on the corrected density data.

Also, another aspect of the present invention is an image density correction method for use in an image forming apparatus that primarily transfers a toner image formed on an image carrier onto an intermediate transfer member, and secondarily transfers the toner image onto a recording sheet to form an image, the image forming method comprising: a detection data acquiring step of (i) setting a plurality of reference voltages, which are each to be referred to when a sensor detects intensity of light reflected from a bare surface of the intermediate transfer member onto which a toner image has not yet been transferred, and (ii) acquiring, at each set reference voltage, a voltage output by the sensor with respect to a predetermined area on the bare surface in a circumferential direction of the intermediate transfer member, as a piece of detection data; a detection data storing step of storing, in a storage, the acquired pieces of detection data in one-to-one correspondence with the reference voltages; a judging step of judging whether to perform image density correction processing of correcting a density of a tonner image to be formed; an output level calibrating step of, when the judgment part judges affirmatively, adjusting an output level of the sensor at the detection of the intensity of light reflected from the bare surface; a density data acquiring step of forming a toner pattern within the predetermined area, and acquiring density data of the toner pattern by causing the sensor, whose output level has been adjusted, to detect intensity of light reflected from the toner pattern; a density data correcting step of reading one of the pieces of detection data from the storage with reference to the adjusted output level, and correct the acquired density data based on the read piece of detection data; and an image density correcting step of performing the image density correction processing based on the corrected density data.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 12 shows a table for bare surface profile data for each set level of reference voltage in FIGS. 11A to 11C;

DESCRIPTION OF THE PREFERRED EMBODIMENTS

The following describes an embodiment of an image forming apparatus relating to the present invention, using an example of applying to a tandem-type color digital printer (hereinafter, simply referred to as "printer").

(1) Overall Structure of Printer

Figure 1:
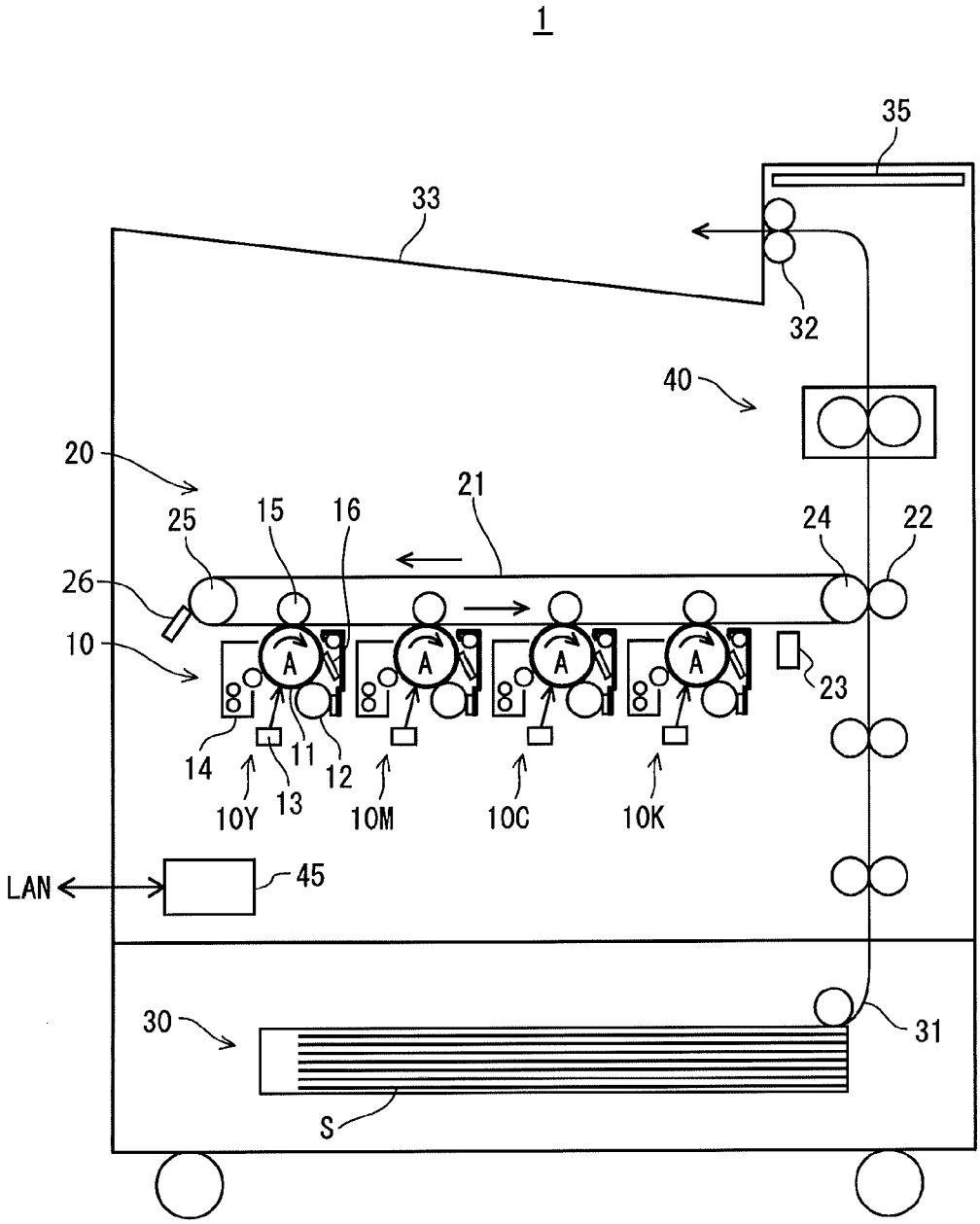
FIG. 1 schematically shows the overall structure of a printer relating to an embodiment of the present invention.

FIG. 1 schematically shows the overall structure of a printer 1 relating to the present embodiment.

The printer 1 forms an image on a recording sheet by a known electrophotographic system. The printer 1 includes an image processing unit 10, an intermediate transfer unit 20, a paper feeding unit 30, a fixing unit 40, and a control unit 45, and selectively executes color or monochrome printing in accordance with a print job received from an external terminal device (not shown) via a network (such as a LAN).

The image processing unit 10 includes image forming subunits 10Y, 10M, 10C, and 10K corresponding to developing colors of yellow (Y), magenta (M), cyan (C), and black (K), respectively.

The image forming subunit 10Y includes a photosensitive drum 11, and a charger 12, an exposing unit 13, a developing unit 14, a primary transfer roller 15, a cleaner 16 that are disposed surrounding the photosensitive drum 11, and so on.

The charger 12 charges a circumferential surface of the photosensitive drum 11 rotating in a direction indicated by an arrow A.

The exposing unit 13 performs exposure-scanning on the charged photosensitive drum 11 by laser light to form an electrostatic latent image on the photosensitive drum 11.

The developing unit 14 houses therein developer containing toner, and develops the electrostatic latent image formed on the photosensitive drum 11 by the toner to form a toner image of Y color on the photosensitive drum 11.

Here, toner used as developer is a polymerized toner having a particle diameter of 7 μm or less and preferably of 4.5 to 6.5 μm. Alternatively, a grinded toner may of course be used. Also, the developing unit 14 may employ either a single-component developer containing only toner or a two-component developer containing toner and carrier.

The primary transfer roller 15 transfers the toner image of Y color formed on the photosensitive drum 11 onto the intermediate transfer belt 21 by electrostatic action. The cleaner 16 cleans residual toner on the photosensitive drum 11Y after transfer of the toner image. Other image forming subunits 10M, 10C, and 10K have the same structure as the image forming subunit 10Y, and accordingly their referential numerals are omitted in FIG. 1.

Also, the intermediate transfer unit 20 includes an intermediate transfer belt 21 suspended in a tension state on a driving roller 24 and a driven roller 25 to rotate in a direction indicated by an arrow.

The intermediate transfer belt 21 is made of a base material that is obtained by dispersing carbon in a polyphenylene sulfide (PPS) resin to adjust to have a surface resistivity of $1\times10^{7}$ to $1\times10^{12}\Omega/\square$ and a volume resistivity of $1\times10^{6}$ to $1\times10^{12}$ Ω·cm. Alternatively, the intermediate transfer belt 21 may be made of a material that is obtained by dispersing a conductive filler, such as carbon or an ionic conductive material, in a resin, such as a polycarbonate (PC) resin, a polyimide (PI) resin, a urethane resin, a fluorine resin, and a nylon resin, so as to adjust a surface resistivity and a volume resistivity.

The intermediate transfer belt 21 is a seamless belt, and is made of a cylindrical base material which is obtained by making injection-molding or centrifugal-molding of the above resin material to have a desired circumferential length determined by design. In order to reduce the manufacturing costs and increase the manufacturing yield, the intermediate transfer belt 21 is manufactured without undergoing shape correction process on a surface of the base material.

In execution of color printing (printing in color mode), toner images of respective colors are formed on the photosensitive drum 11 for each of the image forming subunits 10Y, 10M, 10C, and 10K. The formed toner images are each transferred onto the intermediate transfer belt 21. The operations of forming toner image of Y, M, C, and K colors are performed in accordance with different timings in the running direction of the intermediate transfer belt 21, such that the toner images of the respective colors are layered on the running intermediate transfer belt 21 in the same position to form a full-color toner image.

In accordance with the timing of image formation, the paper feeding unit 30 picks up a sheet S from a paper feed cassette, and conveys the sheet S onto a conveyance path 31 toward a secondary transfer roller 22.

When the sheet S passes through between the secondary transfer roller 22 and the intermediate transfer belt 21, the full color toner image formed on the intermediate transfer belt 21 is secondarily transferred collectively onto the recording sheet S by electrostatic action of the secondary transfer roller 22.

The recording sheet S onto which the full color toner image has been secondarily transferred is conveyed to the fixing unit 40. The full color toner image is heated and pressurized by the fixing unit 40 so as to be sealed and fixed to a surface of the recording sheet S. Then, the recording sheet S is discharged to a discharge tray 33 via a discharge roller 32.

The above description has been given regarding the operations for executing printing in color mode. In execution of monochrome printing (printing in monochrome mode) for example, only the image forming subunit 10K for black color is driven to perform the processes of charge, exposure, development, transfer, and fixing on black color in the same way as in the operations as described above. As a result, image formation (printing) in black color is performed on a recording sheet S.

Note that a toner remaining even after transfer onto the recording sheet S and a toner pattern for density correction processing that are on the intermediate transfer belt 21 are removed by a cleaning blade 26 arranged so as to face the driven roller 25 via the intermediate transfer belt 21.

Also, on a downstream side of the image forming subunit 10K in the running direction of the intermediate transfer belt 21, a density detection sensor 23 is provided, such as a reflective-type photoelectric sensor, which detects a density of toner pattern formed on the intermediate transfer belt 21 in the later-described image density correction processing.

Figure 2:
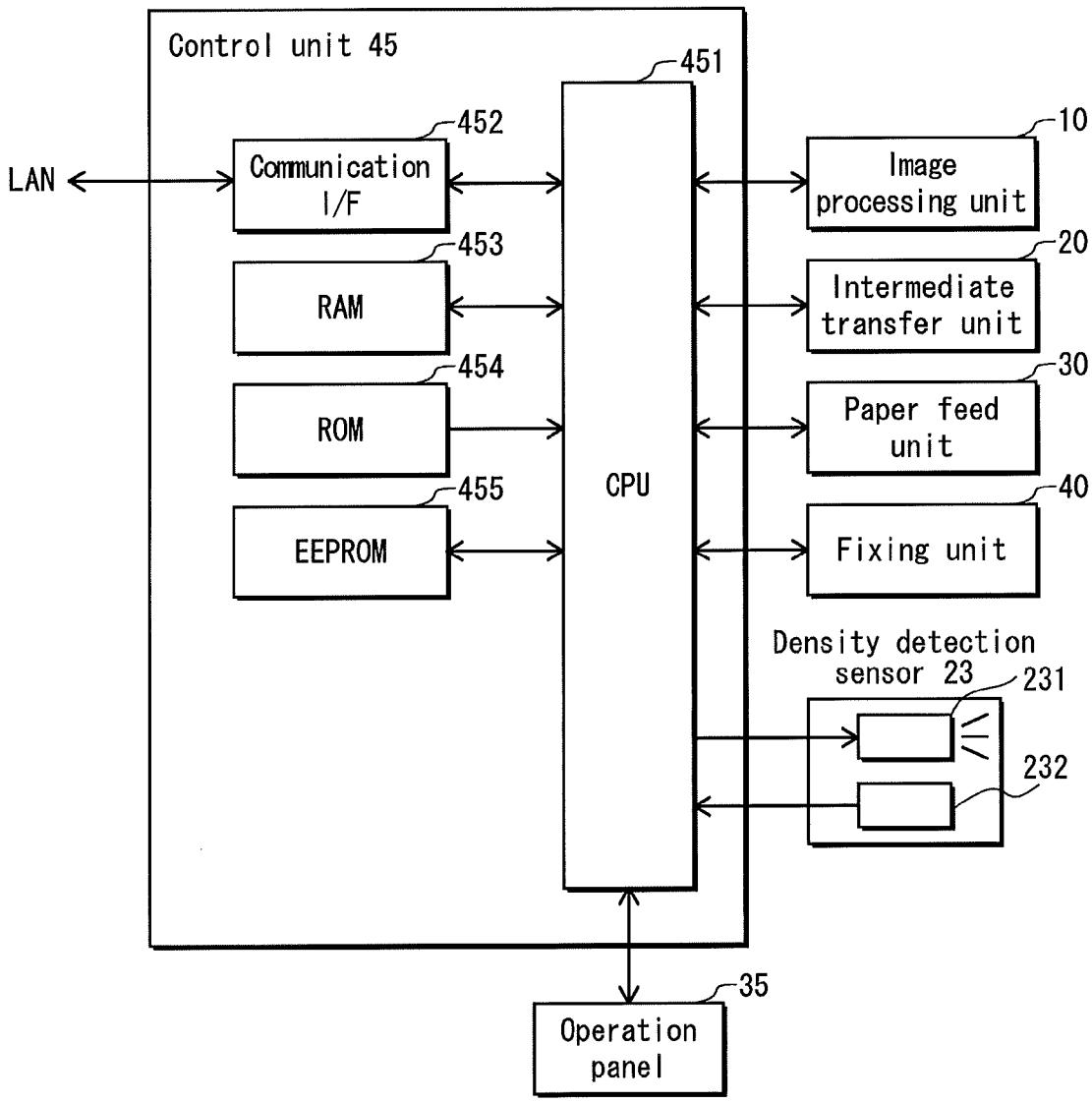
FIG. 2 is a block diagram showing the structure of a control unit of the printer.

The density detection sensor 23 is composed of a light emitting element 231, which emits light of a specific wavelength, and a light receiving element 232, which receives reflected light, that is specular reflected light or diffuse reflected light, from the intermediate transfer belt 21, and outputs a voltage according to an amount of the received light (FIG. 2). The light emitting element 231 and the light receiving element 232 are generally a light emitting diode (LED) and a photodiode (PD), respectively.

Also, on a front and upper portion of the printer 1 where a user conveniently operates, an operation panel 35 is provided. The operation panel 35 includes buttons for receiving user instructions, a touch-screen liquid crystal display, and so on. The operation panel 35 transmits the received instructions to the control unit 45, and displays information indicating the status of the printer 1 on the liquid crystal display.

The control unit 45 controls the compositional units of the printer 1 based on data of a print job received from the external terminal device via the network to realize smooth execution of print operations.

(2) Structure of Control Unit 45

FIG. 2 is a block diagram showing the structure of the control unit 45.

As shown in FIG. 2, the control unit 45 is composed of a CPU 451, a communication I/F (interface) 452, a RAM 453, a ROM 454, an EEPROM 455, and so on.

The communication I/F 452 is a LAN card or a LAN board for connecting an external client terminal to the LAN, and receives data of a print job transmitted from the client terminal via the LAN and transmits the received data to the CPU 451.

The RAM 453 is a volatile memory, and functions as a work area of the CPU 451 in execution of programs.

The ROM 454 stores therein the programs for controlling the operations of the compositional units of the printer 1 and image data for printing toner patterns.

The EEPROM 455 is a recordable nonvolatile memory. In the later-described processing of acquiring bare surface profile data, the EEPROM 455 stores therein values detected by the density detection sensor 23 with respect to a bare surface of the intermediate transfer belt 21 for one turn as "bare surface profile data" in one-to-one correspondence with output levels of the density detection sensor 23 at the detection which have been adjusted to V1', V2', and V3'. The adjusted output level is hereinafter referred to as "reference voltage".

Based on acquired image data, the CPU 451 reads necessary programs from the ROM 454, and performs unified control on the operations of the image processing unit 10, the intermediate transfer unit 20, the paper feeding unit 30, and the fixing unit 40 with appropriate timings to realize smooth execution of image forming operations. Also, the CPU 451 performs image density correction processing based on the output of the density detection sensor 23.

(3) Image Density Correction Processing (3-1) Outline of Image Density Correction Processing Image density correction processing is performed basically in the following manner. Toner patterns for image density correction processing (hereinafter, referred to as just "toner pattern") are formed on the intermediate transfer belt 21. Density detection of the toner patterns is performed by the density detection sensor 23. A detected density value, from which noise that has occurred due to manufacturing-derived scratches on the surface of the intermediate transfer belt 21 has been removed, is compared with an appropriate density value (density value of the toner pattern indicated by the image data stored in the ROM 454). If the values are different from each other, conditions for image process are controlled such that the detected value is equal to the appropriate value.

Figure 3:
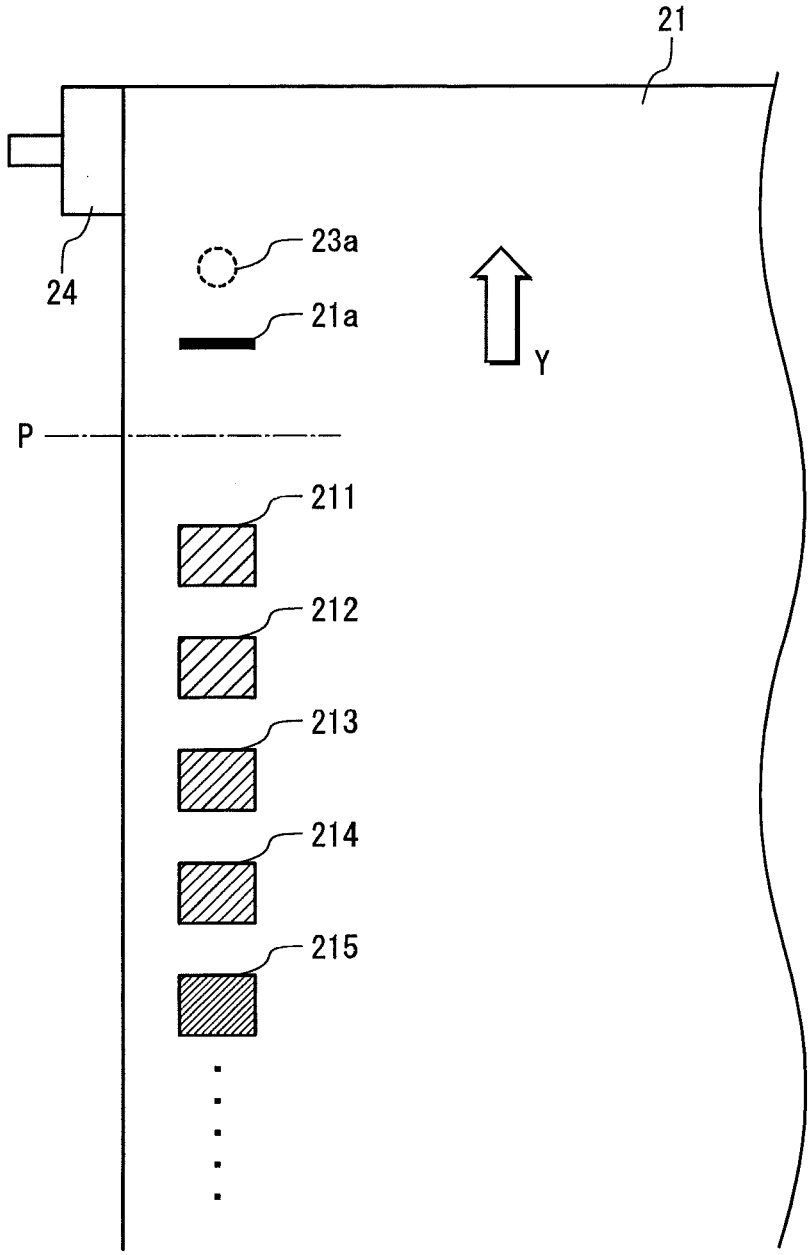
FIG. 3 shows an example of forming a toner pattern on an intermediate transfer belt.

FIG. 3 is a schematic view of the intermediate transfer belt 21 on which toner patterns have been formed, seen from underneath the printer 1 shown in FIG. 1. In FIG. 3, a dashed circle 23*a* shows a detection position on the intermediate transfer belt 21 on which detection is to be performed by the density detection sensor 23, and a mark 21*a* is provided beforehand on the intermediate transfer belt 21 for detecting a home position. The mark 21*a* is formed by, for example, marking with an appropriate paint or attaching a reflective seal during manufacturing the intermediate transfer belt 21.

The intermediate transfer belt 21 is rotated in a direction indicated by a white arrow Y in FIG. 3. The home position is where the intermediate transfer belt 21 is located when the mark 21*a* is detected by the density detection sensor 23.

If the mark 21*a* is detected, the control unit 45 controls the image processing unit 10 and the intermediate transfer unit 20 to form toner patterns 211, 212, 213, . . . in accordance with predetermined timings.

Image data for each toner pattern, which relates to shape and density of the toner patterns 211, 212, 213, . . . , is stored beforehand in the ROM 454. The CPU 451 performs the control to form the toner patterns based on the image data.

Image density correction processing generally includes maximum density correction processing and gradation correction processing for each of colors of C, M, Y, and K. In maximum density correction processing, toner patterns are formed on the intermediate transfer belt 21 based on image data for toner pattern relating to the maximum density, and in order to match a detected density value of each formed toner pattern with the appropriate density value indicated by the image data, laser output of the exposing unit 13 is adjusted, a voltage is changed which is to be applied to the charger 12 or a developing roller included in the developing unit 14 or a plurality of half-tone toner patterns are formed. Then, in gradation correction processing, density correction for each gradation (gradation correction) is performed based on this detected value.

In the embodiment, description is given below regarding density correction on a half-tone toner pattern, which has show-through of manufacturing-derived scratches occurred on the intermediate transfer belt 21, for the reason that such a case greatly exerts an influence on density detection.

Figure 4:
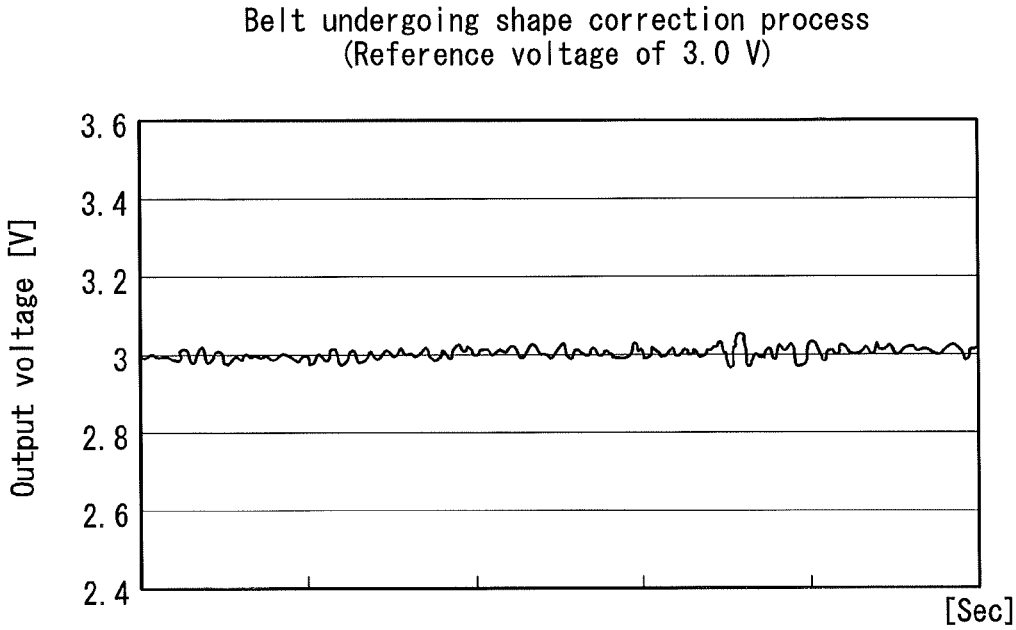
FIG. 4 shows variation in output voltage of a density detection sensor performing detection on a bare surface of the intermediate transfer belt that has undergone shape correction process for removing manufacturing-derived scratches from its surface.

FIG. 4 partially shows variation in output voltage of the density detection sensor 23 whose reference voltage is set to 3.0 V. Here, the intermediate transfer belt 21 has undergone shape correction process for removing manufacturing-derived scratches from its surface. The detection is performed in a period of one-turn rotation of the intermediate transfer belt 21.

The horizontal axis represents an elapsed time since detection of the home position, and the vertical axis represents value detected by the density detection sensor 23. Hereinafter, a detection result by the density detection sensor 23 with respect to a bare surface of the intermediate transfer belt 21 for one turn is referred to as "bare surface profile" representing the state on the bare surface, and a group of detection values is referred to as "bare surface profile data".

In the case where shape correction process is performed on the intermediate transfer belt 21 in this way, there occurs only a variation caused by electrical noise in circuits, and there occurs no large variation in bare surface profile.

Generally, it is experimentally known that variation in output voltage in a range of ±0.1 V with respect to reference voltage exerts little influence on image density correction processing. There is no problem in the bare surface profile such as shown in FIG. 4.

Figure 5:
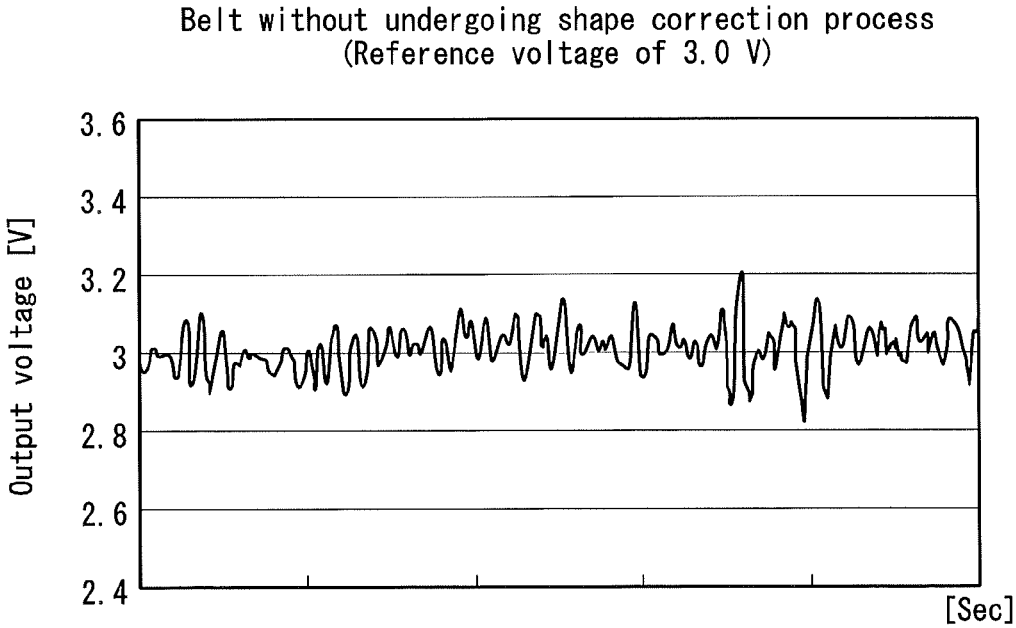
FIG. 5 shows variation in output voltage of the density detection sensor performing detection on a bare surface of the intermediate transfer belt that has not undergone shape correction process for removing manufacturing-derived scratches from its surface.

However, the intermediate transfer belt 21, which has not undergone shape correction process, has many manufacturing-derived scratches remaining on its surface. A bare surface profile of this intermediate transfer belt 21 shows a great variation range exceeding 0.1 V with respect to the reference voltage, as shown in a graph in FIG. 5.

Figure 6:
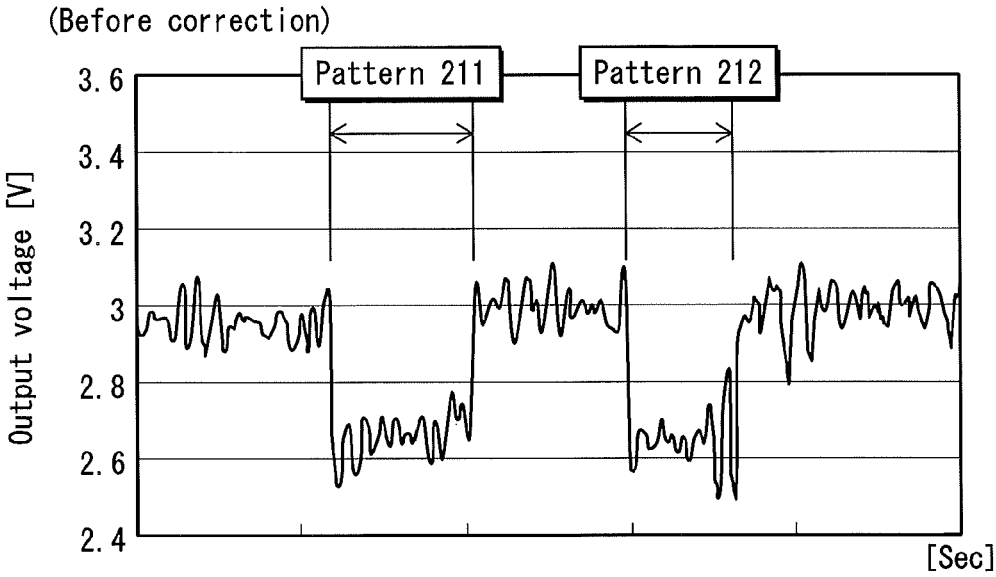
FIG. 6 shows variation in output voltage of the density detection sensor performing detection on a toner pattern formed on the intermediate transfer belt that has not undergone the shape correction process.

If half-tone toner patterns are formed on the intermediate transfer belt 21 that has not undergone shape correction process, show-through of the manufacturing-derived scratches appears on the toner patterns. This results in a large variation in output voltage of the density detection sensor 23 when performing detection on the toner patterns, as shown in FIG. 6. Note that FIG. 6 shows, as an example, detection values corresponding to detection on the two toner patterns 211 and 212 formed based on the same density data among the above toner patterns.

Particularly in the case where there is a large variation in detection values such as the case of the toner pattern 212, any average of the detection values cannot reach the precise density of the toner pattern 212 because of too large error.

Figure 7:
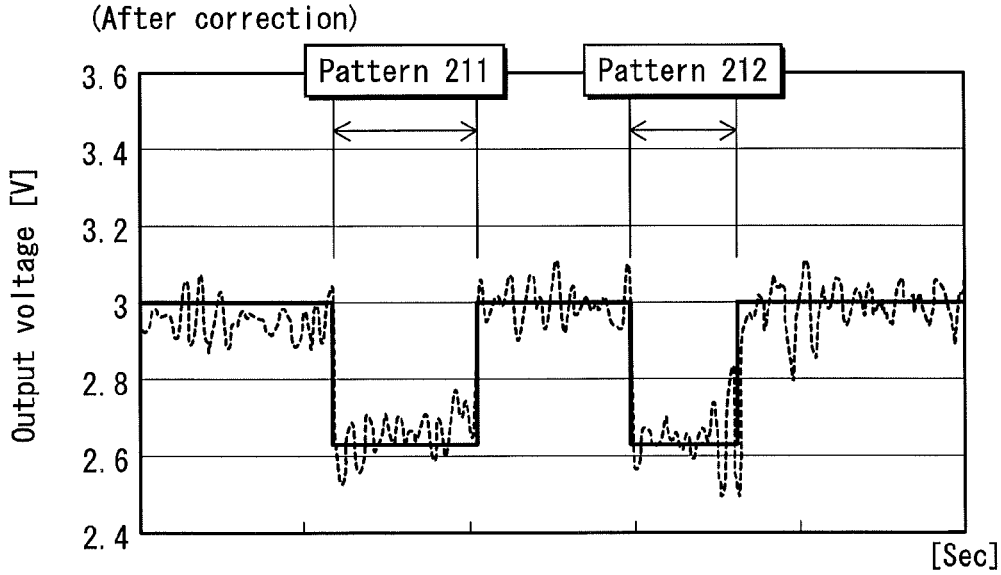
FIG. 7 shows variation in the output voltage shown in FIG. 6 that is corrected based on bare surface profile data that has been acquired beforehand.

In consideration this, bare surface profile data is deducted for correction from the detected data of the toner pattern at the same rotational phase. This cancels out the variation in detection data due to the manufacturing-derived scratches on the surface of the intermediate transfer belt 21, thereby obtaining more precise output data from which the variation due to the manufacturing-derived scratches has been removed, as shown by a solid line in FIG. 7.

Accordingly, in order to perform image density correction processing with no influence of manufacturing-derived scratches on the intermediate transfer belt 21, the following procedure is necessary. Firstly, bare surface profile data is acquired, and a toner pattern is formed, and then bare surface profile data having the same rotational phase is deducted from detection data of the toner pattern.

However, if bare surface profile data is always acquired immediately before image density correction processing, it takes a long time to perform image density correction processing by the acquisition. This goes against the demand for reduction of downtime as possible.

In order to meet this demand, there is considered the following method. Before use of the printer 1 by a user, such as before shipping and at the initial power-on after delivery, bare surface profile data is acquired. Then, when image density correction processing is actually performed, the bare surface profile data is read to correct the density detection data. However, the output voltage level of the density detection sensor 23 at acquisition of the bare surface profile data is different from the output voltage level of the density detection sensor 23 at actual performance of image density correction processing. Accordingly, a variation range of output voltage of the density detection sensor 23 due to manufacturing-derived scratches on the intermediate transfer belt 21 is also different therebetween. This makes it impossible to perform precise correction by canceling each other.

The following provides a specific description. The output voltage of the density detection sensor 23 varies due to its deterioration over time, a stain of toner on a light emitting surface or a light receiving surface, or the like, as described above. On the other hand, the light receiving element 232 of the density detection sensor 23 is typically photodiode, which has an appropriate voltage range where an excellent sensitivity is obtained with respect to variation in density that is caused by linear variation in output voltage depending on variation in amount of received light (range of 2.0 to 4.0 V, for example).

Accordingly, in order to detect density of a toner pattern, the output level of the density detection sensor 23 needs to be adjusted for calibration so as to be a specific value ("3.0 V" in the present embodiment) within the appropriate voltage range.

This adjustment is performed by controlling the light amount of the light emitting element 231 (FIG. 2). Generally, the light amount is digitally controlled according to a voltage value to be applied to the light emitting element 231, which changes from 0 V to the maximum Vmax in a stepwise manner (separation into 256 steps, for example).

Suppose that before shipping or at the initial power-on after delivery, the reference voltage of the density detection sensor 23 at acquisition of bare surface profile data is 3.0 V. In such a case, the reference voltage of the density detection sensor 23 at performance of image density correction processing matches with 3.0 V, and density detection is performed on a toner pattern. Then, a difference between these output values is obtained. This can precisely eliminate the influence of manufacturing-derived scratches on the surface of the intermediate transfer belt 21.

However, as described above, since there is a certain control width in the light amount of the light emitting element 231 because of being digitally controlled, the light amount varies in a stepwise manner. This makes it difficult to completely match the output value of the light receiving element 232 with the target value.

Figure 8:
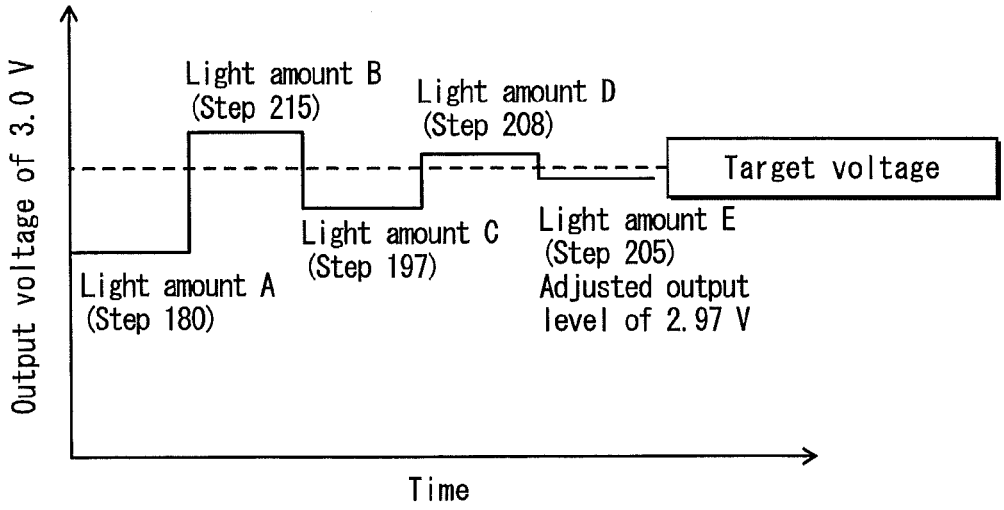
FIG. 8 shows variation in output voltage while a light amount of a light source is controlled, such that the density detection sensor has an output level to be closer to a target value (3.0 V) at detection on the bare surface of the intermediate transfer belt.

FIG. 8 shows an example where the reference voltage of the density detection sensor 23 is adjusted to be closer to a target value of 3.0 V described above.

Firstly, a voltage of Step 180, which has been set to the default value, is applied to the light emitting element 231 to have a light amount A. An output voltage of the light receiving element 232 at this time is detected by a voltage detector, which is not shown. A difference between a value of the output voltage and 3.0 V is fed back to the CPU 451. Next, a voltage of Step 215 is applied to the light emitting element 231, and a similar process is performed. Such voltage application and feedback are repeatedly performed. When the difference between the value of the output voltage of the density detection sensor 23 and the target value falls below a predetermined value (0.1 V at a maximum), the settings of the reference voltage of the density detection sensor 23 are terminated.

In this example, when a voltage of Step 205 is applied to the light emitting element 231 to have a light amount E, the output voltage of the density detection sensor 23 reaches 2.97 V. Accordingly, the adjustment processing is terminated.

However, depending on the degree of ununiformity of products, deterioration over time, a stain of toner on a light emitting surface or a light receiving surface, or the like, it sometimes takes longer time to adjust the output voltage, and the processing cannot be speedily performed.

Figure 9:
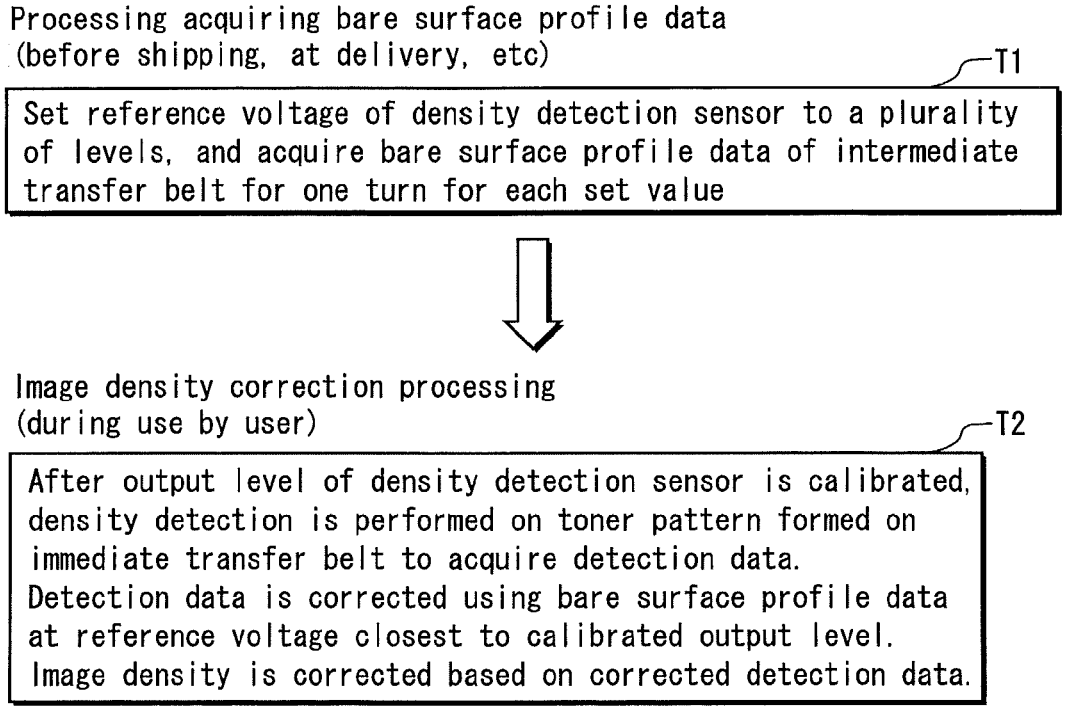
FIG. 9 shows the outline of image density correction processing relating to the embodiment of the present invention.

According to the present embodiment in consideration of this, image density correction processing is performed in accordance with the basic procedure as shown in FIG. 9. This realizes efficient performance with no increase of the downtime and no influence of manufacturing-derived scratches on the surface of the intermediate transfer belt 21.

(A) Processing of Acquiring Bare Surface Profile Data

At a stage where voltage settings have no influence on use of the printer 1 by the user, such as before shipping or after delivery of the printer 1, a plurality of levels for reference voltage are set beforehand, and bare surface profile data is acquired for each reference voltage (T1).

(B) Image Density Correction Processing (Narrow Sense)

In the image density correction processing, the output level of the density detection sensor 23 is adjusted for calibration, and then detection is performed on a toner pattern formed on the transfer belt to acquire detection data. The detection data is corrected using surface profile data at the reference voltage which is closest to the adjusted output level. The image density is corrected based on the corrected detection data (T2).

According to this method, it is not always necessary to adjust the output level of the density detection sensor 23 to match with a particular voltage value in calibration processing. This realizes speedy and precise performance of image density correction processing.

The following describes the processing in detail.

(3-2) Processing of Acquiring Bare Surface Profile Data

Figure 10:
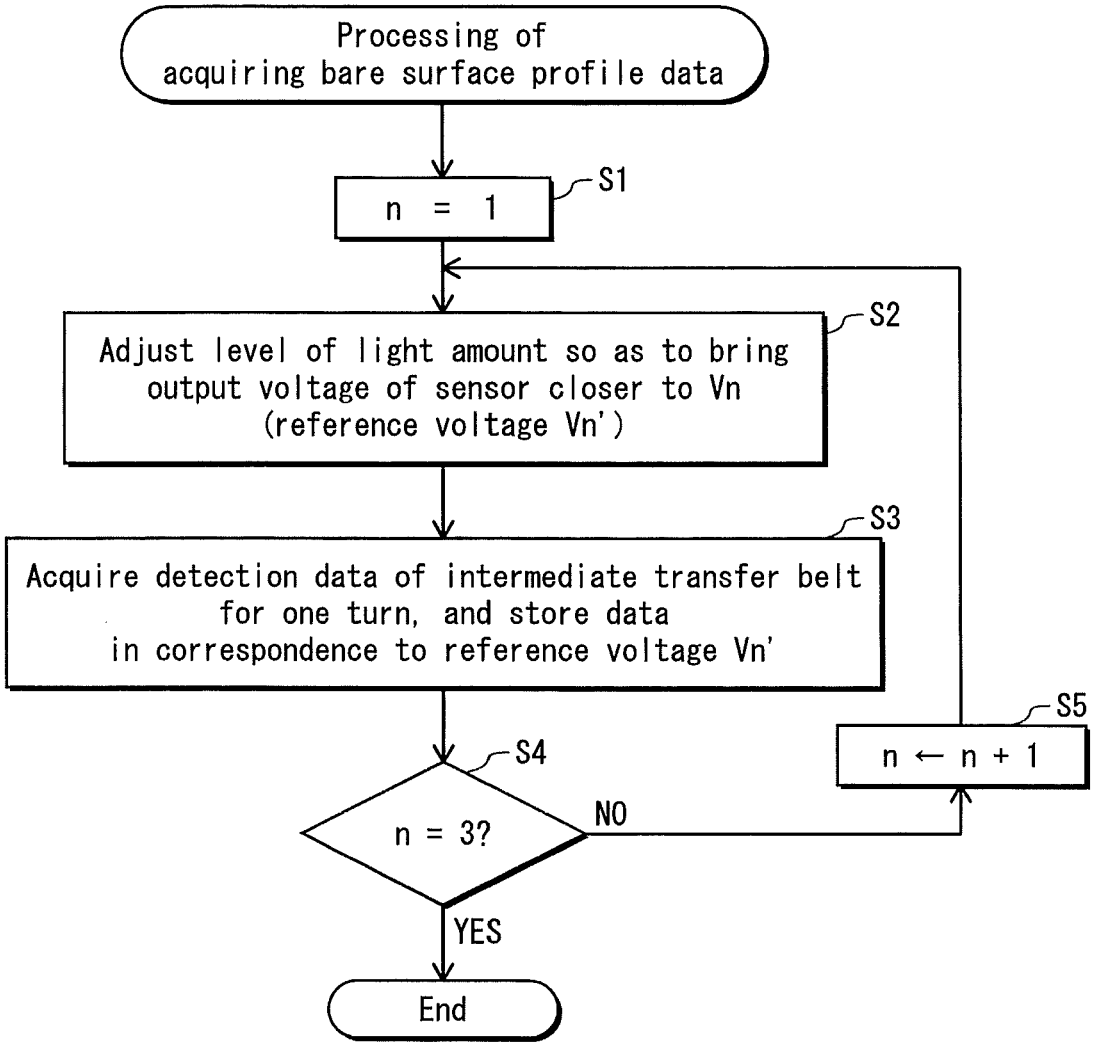
FIG. 10 is a flow chart showing the control of processing of acquiring bare surface profile data of the intermediate transfer belt.

FIG. 10 is a flow chart showing the control of processing of acquiring bare surface profile data performed by the control unit 45.

This processing of acquiring bare surface profile data is performed before use of the printer 1 by a user, such as before shipping and at delivery of the printer 1, by a worker of a manufacturer or a serviceman instructing a receiver for receiving an instruction to perform the processing. This receiver may, for example, be included in an operation screen of the operation panel 35, or be realized as an exclusive instruction switch provided inside the printer 1.

In the present embodiment, the light amount of the light emitting element 231 is adjusted such that when the density detection sensor 23 performs detection on the bare surface, output voltage levels of the detection sensor 23 are three different reference voltages. And then, bare surface profile data is acquired at each level of output voltage.

Specifically, the ROM 454 stores therein three voltage values Vn (n=1, 2, 3) as target voltages to which the output voltage of the density detection sensor 23 should be adjusted. These target voltages of V1 to V3 are selected from among values within the appropriate voltage range where an excellent sensitivity is obtained with respect to variation in density due to linear variation in output voltage in proportion to variation in amount of received light of the light receiving element 232.

In Step S1, n=1 is set. In Step S2, the target voltage V1 is read from the ROM 454, and a light amount of the light emitting element 231 is adjusted in the same manner as shown in FIG. 8. The output voltage of the density detection sensor 23 when performing detection on the bare surface of the intermediate transfer belt 21, which is closest to the target voltage V1, is set as a reference voltage V1'.

Here, it is desirable to determine, as the same detection position on the bare surface for setting the reference voltages, a position where the intermediate transfer belt 21 is rotated from the home position for a predetermined time.

The predetermined time ends when a reference clock output by the CPU 451 of the control unit 45 since detection of the home position reaches a value set beforehand in the ROM 454.

In the present embodiment, when a position P of the intermediate transfer belt 21, which is virtually shown in FIG. 3, moves to the detection position 23*a* of the density detection sensor 23, the output voltage of the density detection sensor 23 is set as the reference voltage, for example. Hereinafter, the position P on the intermediate transfer belt 21 for determining reference voltages is simply referred to as "detection position P".

Note that a plurality of detection positions P may be provided in a section having an appropriate length in a circumferential direction of the intermediate transfer belt 21 (length sufficiently shorter than one turn). In such a case, the reference voltage is adjusted with use of an average of all values detected on these detection positions P or an average of the detected values except the maximum and minimum values. As a result, even if manufacturing-derived scratches are found on a particular one detection position P, influence of the manufacturing-derived scratches can be reduced.

Then, the intermediate transfer belt 21 is returned to the home position. The light amount of the light emitting element 231 is fixed to the above adjusted value. The intermediate transfer belt 21 is rotated, and detection data for one turn detected by the density detection sensor 23 is acquired. The acquired detection data is stored as bare surface profile data in a table for bare surface profile data in the EEPROM 455, in correspondence with the reference voltage V1' (Step S3).

Then, it is judged whether n=3 is satisfied (Step S4). If it is judged that n=3 is not satisfied (Step S4: No), n is incremented by 1 (Step S5). Then, the processing in Steps S2 and S3 is repeatedly performed. Specifically, n=1 is satisfied immediately after detection at the reference voltage V1'. Accordingly, n=2 is set, and the target voltage V2 is read from the ROM 454. Bare surface profile data at a reference voltage V2', which has been adjusted based on the target voltage V2, is acquired and stored.

The above processing is performed with respect to the target voltage V3 to acquire and store bare surface profile data at an adjusted reference voltage V3' (Step S4: Yes), and then the processing is terminated.

Here, for convenience of the description, the reference voltages V1', V2', and V3' of the density detection sensor 23 are adjusted to 2.9 V, 3.0 V, and 3.1 V, respectively.

Figure 11A:
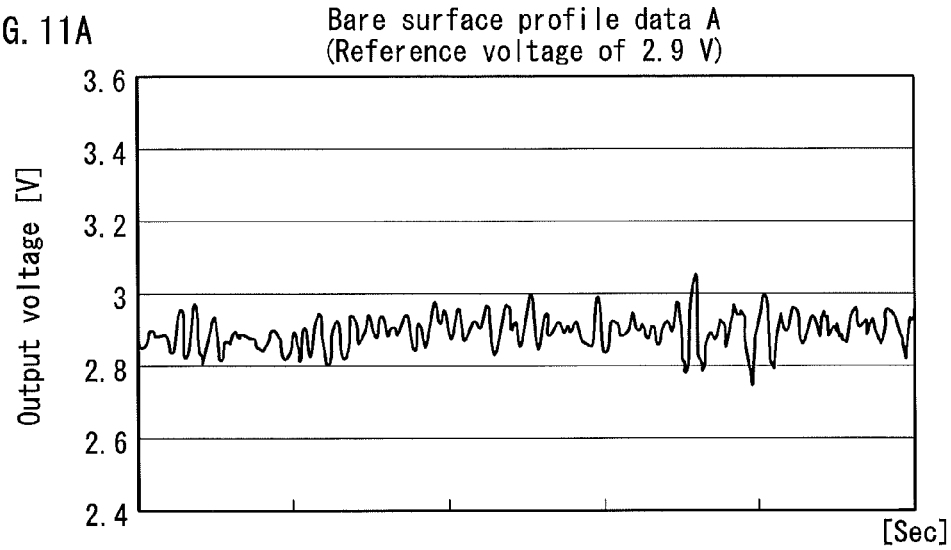
FIGS. 11A to 11C show pieces of bare surface profile data of the intermediate transfer belt corresponding to the reference voltages of the density detection sensor that are set to levels of 2.9 V, 3.0 V, and 3.1 V, respectively.
Figure 11B:
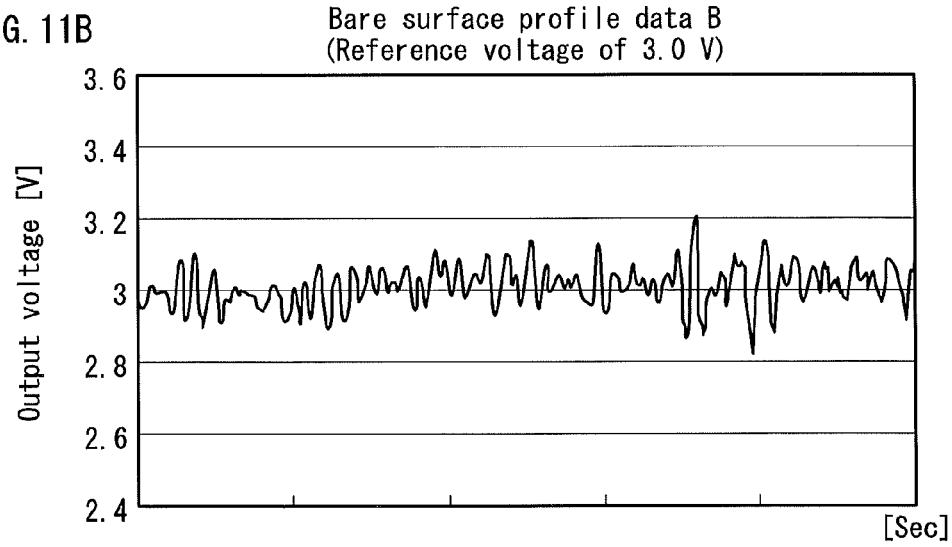
Figure 11C:
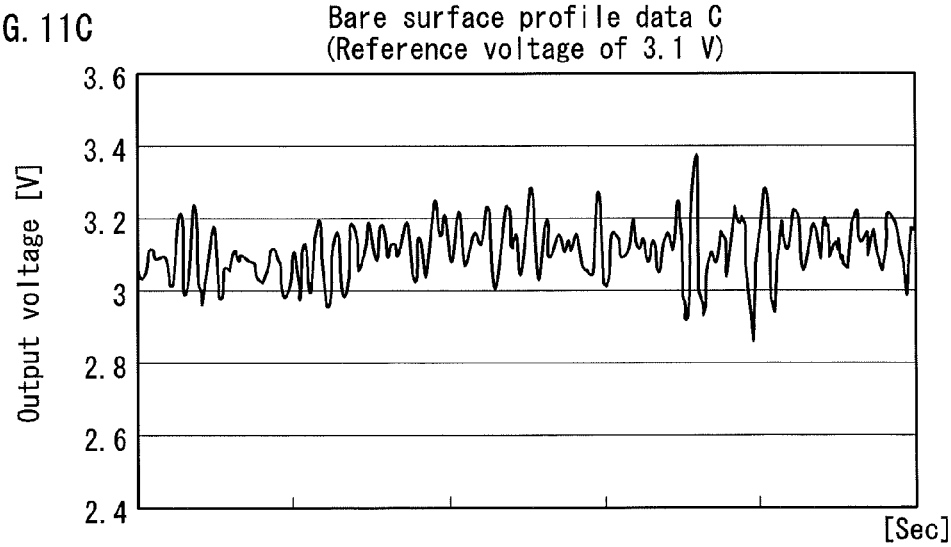

FIGS. 11A, 11B, and 11C show graphs of examples of bare surface profile data A, B, and C at the adjusted reference voltages of 2.9 V, 3.0 V, and 3.1 V, respectively.

As shown in the graphs, as a value of the reference voltage increases (in other words, as the light amount of the light emitting element 231 increases), the variation in output voltage at a time when manufacturing-derived scratches are detected increases.

Specifically, with respect to each piece of bare surface profile data, a sampling clock generated in the CPU 451 is counted since detection of the mark 21*a* by the density detection sensor 23 (equivalent to "counter" in Claim). An output voltage of the density detection sensor 23 is held in accordance with each sampling clock, and then is stored in the table for bare surface profile data included in the EEPROM 45. This sampling processing is repeatedly performed until next detection of the home position. Here, the sampling clock has a cycle of approximately 0.001 to 0.002 seconds, for example.

FIG. 12 shows an example of the table for bare surface profile data where values obtained by detection on the intermediate transfer belt 21 are stored in the order of sampling in correspondence with the reference voltages V1', V2', and V3'.

(3-3) Image Density Correction Processing

Figure 13:
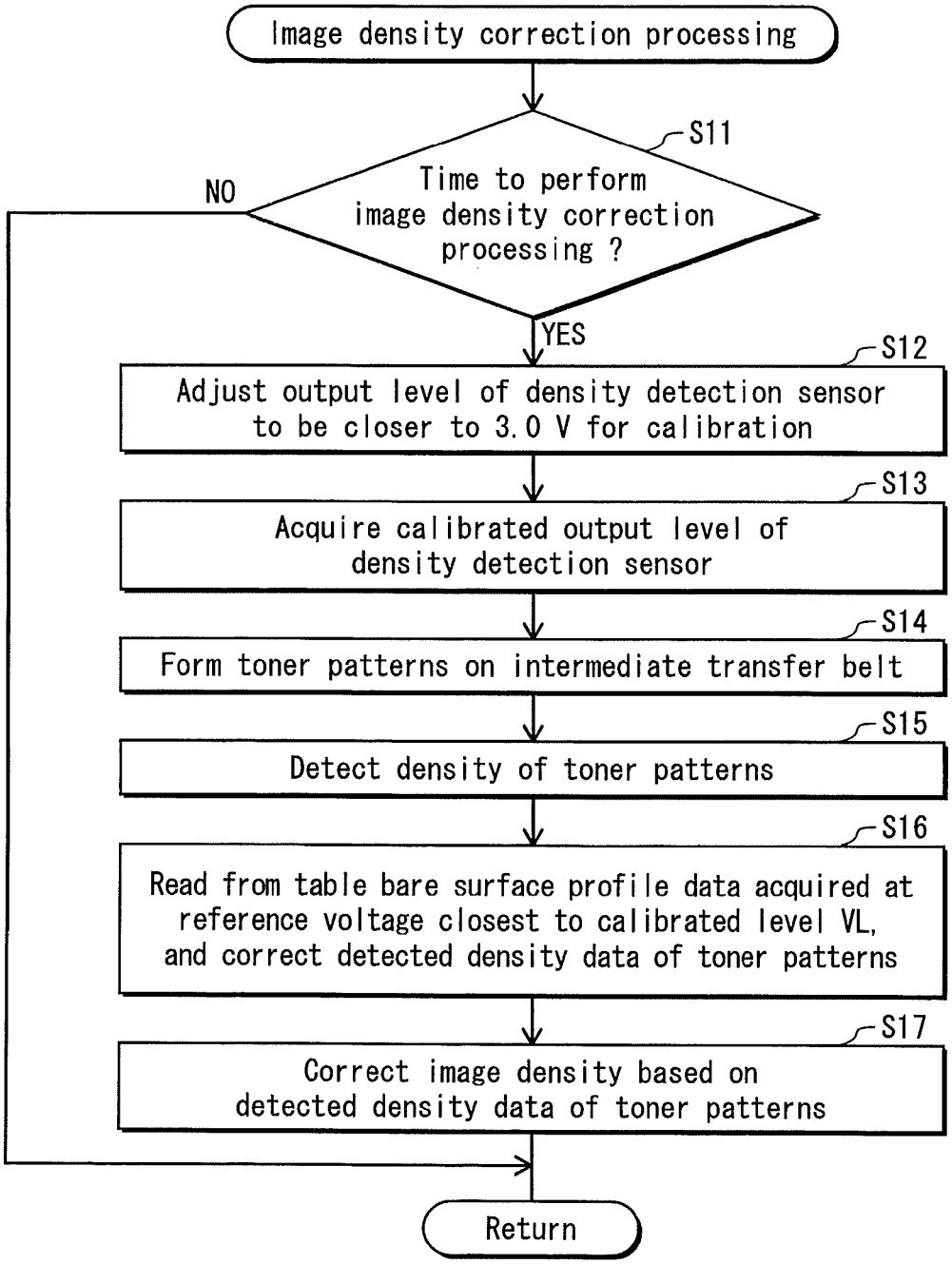
FIG. 13 is a flow chart showing the control of image density correction processing.

FIG. 13 is a flow chart showing the control of image density correction processing performed by the control unit 45, which is executed as a sub routine of a main flow chart (not shown) for controlling the whole operations of the printer 1.

Firstly, it is judged whether it comes time to perform image density correction processing (Step S11).

This judgment is performed by judging whether a predetermined condition necessary for executing image density correction processing is satisfied.

This predetermined condition itself has no novelty, and has been conventionally used in many image forming apparatuses. The predetermined condition is satisfied when any one or more of the following is satisfied for example, in addition to that the printer 1 has been powered on immediately previously: (a) that a print job has been received; (b) that the temperature and/or humidity in the printer 1 exceeds a predetermined threshold value; and (c) that the number of recording sheets printed after the most recent execution of image density correction processing exceeds a predetermined value (for example 1000). Higher-end models tend to perform image density correction processing more frequently.

Note that when the above condition (b) or (c) is satisfied during execution of a print job for example, the print job may be immediately interrupted to perform image density correction processing. Also, when the number of recording sheets that have not been yet printed is less than a predetermined value, it may be possible to continuously execute the print job without interruption, and perform image density correction processing after completion of the print job. Particularly with respect to color printing that needs reproduction with a high image quality, it is desirable that when the condition (b) or (c) is satisfied during execution of a print job, the print job is immediately interrupted to perform image density correction processing.

When it is judged that it comes time to perform image density correction processing (Step S11: Yes), the intermediate transfer belt 21 is rotated, and an output voltage at detection on the detection position P is adjusted for calibration so as to be closer to 3.0 V (Step S12). Specifically, the light amount of the light emitting element 231 is adjusted in the same way as shown in FIG. 8. The final output voltage of the density detection sensor 23 at the detection position P is acquired as a calibrated output level (hereinafter, simply referred to as "calibrated level") VL, and is stored in the RAM 453 or the EEPROM 455 (Step S13).

Here, an adjustment time is set. Even if the output voltage does not match with the target voltage (3.0 V), a value which is close to +2.9 V or +3.1 V within a range of 3.0 V±0.1 V is determined as the calibrated level VL within the adjustment time. This can offer speedy performance of the processing without exceeding the adjustment time.

Next, toner patterns 211, 212, 213, . . . such as shown in FIG. 3 are formed on the intermediate transfer belt 21 (Step S14). Here, the CPU 451 reads image data for each toner pattern for density detection from the ROM 454. After the home position of the intermediate transfer belt 21 is detected by the density detection sensor 23, and toner patterns are formed on the intermediate transfer belt 21 in accordance with predetermined timings. Here, the toner patterns are each formed based on a different one of a plurality of density data of density values each belonging to half-tone range.

With the rotation of the intermediate transfer belt 21, a toner pattern formed on the intermediate transfer belt 21 is detected by the density detection sensor 23 (Step S15).

Specifically, when the intermediate transfer belt 21 is rotated and the home position on the intermediate transfer belt 21 is detected, sampling is performed on the output voltage of the density detection sensor 23 at a sampling clock that is the same as at acquisition of bare surface profile data. The sampled output voltages are stored in a detection data table (not shown) included in the EEPROM 455 that is similar to that shown in FIG. 12 in numerical order of sampling.

Next, from the table for bare surface profile data shown in FIG. 12, bare surface profile data acquired at a reference voltage closest the calibrated level VL is read, and the detection data of the toner pattern acquired in Step S15 is corrected based on the read bare surface profile data (Step S16).

Here, if the calibrated level VL is "2.97 V" that is the same as the case shown in FIG. 8, bare surface profile data acquired at the reference voltage of 3.0 V is read from the table for bare surface profile data. Processing is performed for deducting the acquired bare surface profile data from detection data of the toner patterns having the same sampling number to correct detection data of the tonner patterns, and the corrected detection data of the tonner patterns is stored in the RAM 453 or the EEPROM 455 as corrected density detection data.

Then, image density correction processing is performed based on the corrected density detection data (Step S17).

Suppose a case where the image density is expressed in 256 gradations of 0 to 255 and the toner pattern 211 has image data of a density value of "100", for example.

In this case, firstly, averaging is performed on corrected density detection data having sampling numbers corresponding to the section in which the toner pattern 211 is formed to obtain an average value V211. Then, a density value corresponding to the average value V211 is calculated based on a correspondence table (not shown) stored in the ROM 454 showing the relationship between the detection data and density values.

Here, when the average value V211 is calculated as the density value of "90", the detected density value is lower than the appropriate density value by "10". Accordingly, a table (not shown) for gradation correction curve (γ curve) included in the EEPROM 455 is corrected such that when image data has an input signal of a detected density value of "100", an output signal increases by approximately 11% (10/90=0.1111 . . . ).

This processing is performed on a toner pattern of each density, and the gradation correction curve is corrected finally. This completes the image density correction processing, and the flow returns to the main flow chart.

Note that the above example of the image density correction processing by correcting the gradation correction curve is just one example. Other known method may be employed for performing image density correction processing.

By performing image density correction processing with respect to all the reproduction colors of C, M, Y, and K, it is possible to realize image formation with a high gradation reproducibility in which the influence of manufacturing-derived scratches on the intermediate transfer belt 21 has been eliminated.

Furthermore, bare surface profile data necessary for correcting density detection data is acquired before usage or during an early stage of usage. Since then, when image density correction processing is performed, it is unnecessary to again acquire bare surface profile data. Accordingly, it is possible to reduce a time necessary for actually performing image density correction processing as short as possible.

MODIFICATION EXAMPLES

Although the present invention has been described based on the embodiment, the present invention is not limited to the above embodiment. The following modification examples may be employed.

(1) In the above embodiment, detection data of a toner pattern is corrected using bare surface profile data acquired at a reference voltage that is closest to a calibrated level at image density correction processing. Alternatively, it may be possible to estimate bare surface profile data at a reference voltage that matches with the calibrated level at the image density correction processing, based on bare surface profile data that has been already acquired, and correct detection data of a toner pattern based on the estimated bare surface profile data. This can realize more precise performance of image density correction processing.

In the processing of acquiring bare surface profile data, when bare surface profile data acquired at each reference voltage Vn' (n=1, 2, 3) is represented as PDn, and (PDn-Vn')=Dn is defined, the value Dn represents a difference (variation) from the reference voltage at detection on the bare surface, and represents density variation due to manufacturing-derived scratches or the like. Suppose that bare surface profile data acquired at a calibrated level VL is represented as PDL, a difference between PDL and VL is represented as DL, and $Vn-1<VL<Vn$ is satisfied. In this case, as shown in FIGS. 11A to 11C, there is a tendency that as the reference voltage increases, an output variation at detection of the bare surface monotonically increases. Accordingly, when the reference voltage matches with the adjusted voltage VL, bare surface profile data PDL is represented by a linear interpolation as follows: $PDL=(Dn-Dn-1)\times VL/(Vn-Vn-1)+VL$.

By correcting detection data of a toner pattern using this approximated bare surface profile data PDL, it is possible to perform more precisely image density correction processing.

Note that, in such interpolation, it is convenient to calculate beforehand a function of correction coefficient for obtaining a difference D corresponding to a predetermined reference voltage.

Suppose that the correction coefficient and the reference voltage are represented as variables "α" and "Vs", respectively. When a correction coefficient at the reference voltage V2 is 1 and correction coefficients at reference voltages V1 and V3 are α1 and α3, respectively, $\alpha 1=D1/D2$ and $\alpha 3=D3/D2$ are satisfied.

Accordingly, in a coordinate system with the reference voltage Vs as a horizontal axis and the correction coefficient α as a vertical axis, it is possible to obtain a function representing a straight line passing through points (α1,V1), (1,V2), and (α3,V3).

Figure 14:
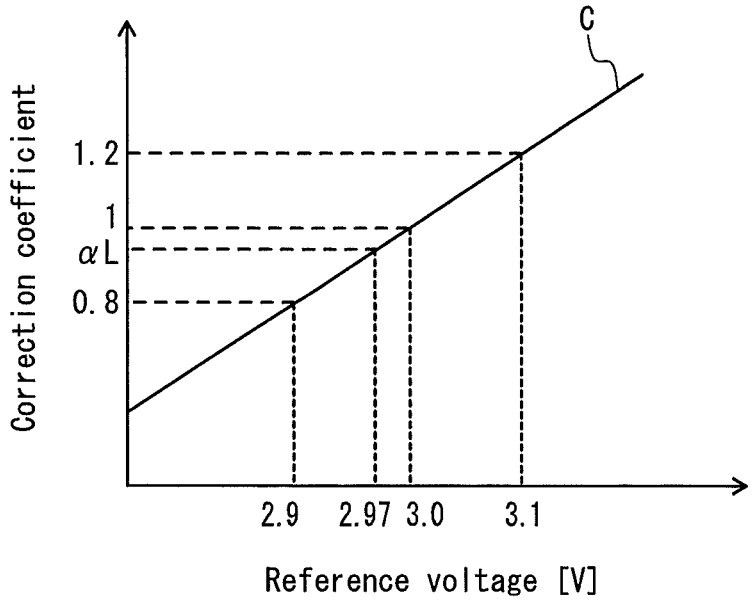
FIG. 14 is a graph showing the correlation between correction coefficient and reference voltage such that bare surface profile data corresponding to a level of an adjusted output level for detection on tonner patterns is estimated based on bare surface profile data that has been acquired beforehand.

Here, the values D1 to D3 are each obtained based on actual measured values that are detected in the processing of acquiring bare surface profile data, thereby easily obtaining the values α1 and α2. In this example, supposing that α1=0.8 and α2=1.2 are obtained and the difference D proportionally increases, the correlation between the correction coefficient α and the reference voltage Vs is represented as shown in FIG. 14.

Since an expression represented by a straight line C can be easily obtained, it is possible to easily obtain a correction coefficient αL when the reference voltage Vs is equal to the calibrated level VL (in the above embodiment, VL of 2.97 V corresponds to αL of 0.94).

As a result, bare surface profile data PDL when the reference voltage VS is equal to the calibrated level VL is obtained as follows: $PDL=\alpha L\times D2+VL$.

In this way, detection data of a toner pattern is corrected based on the obtained bare surface profile data PDL. This can realize speedy and precise image density correction processing.

According to such a method of interpolating bare surface profile data based on the calibrated level, when the output level of the density detection sensor 23 is adjusted, it is unnecessary to maximally approximate the value to the target voltage (3.0 V in the above embodiment). For example, the approximated value may be 2.92 V. This can reduce a time necessary for the calibration processing.

(2) Also, the intermediate transfer belt 21 may have a solid thin film layer on a transfer surface thereof. This solid thin film layer is formed by, for example, layering a thin film of inorganic oxide such as SiO2 on at least a side of the transfer surface of the intermediate transfer belt 21 so as to have a predetermined thickness, with use of a known plasma CVD method which is proposed Japanese Patent Application Publication No. 2007-212921.

The solid thin film layer has a thickness d that desirably satisfies 10 nm<d<1000 nm and more desirably satisfies 100 nm<d<500 nm, in the viewpoint of preventing crack and separation.

This increases the hardness of the surface of the intermediate transfer belt 21 so as to have an abrasion resistance. As a result, it is possible to exhibit an excellent effect of the increase of the transfer rate as shown below, in addition to the improvement of the durability of the intermediate transfer belt 21.

Figure 15:
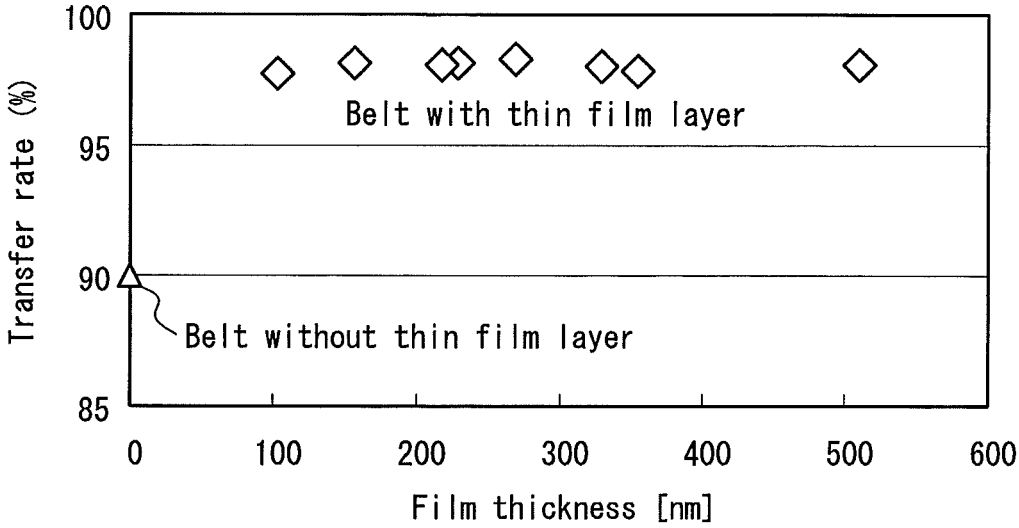
FIG. 15 is a graph showing the relationship between thickness of a surface-hardened film formed on a circumferential surface of the intermediate transfer belt and transfer rate.

FIG. 15 is a graph of an experiment result showing relationship between the thickness of the $SiO_2$ solid film layer formed on the intermediate transfer belt 21 and the transfer rate. In this graph, the horizontal axis represents the thickness of the solid thin film layer, and the vertical axis represents, in percent, the transfer rate of primarily transferring a toner image from the photosensitive drum onto the intermediate transfer belt.

As found from this experiment result, the transfer belt having a solid thin film layer exhibits the transfer rate of close to approximately 100%, which is higher than the transfer belt having no solid film layer by as much as 7 to 8%.

Also, as long as the solid thin film layer has a thickness within a range of approximately 100 to 500 nm, the transfer rate of close to approximately 100% can be maintained. Accordingly, even if manufacturing-derived scratches on the intermediate transfer belt 21 causes the solid thin film layer to have a thickness that differs between a part corresponding to the manufacturing-derived scratches and other parts to some extent, no influence is exerted on the transfer rate.

On the other hand, this type solid thin film layer is substantially transparent. If the solid film layer has a thickness that differs between parts due to manufacturing-derived scratches on the surface of the intermediate transfer belt 21 such as the above, there might be variation in amount of reflected light due to an optical interference between reflected light of a predetermined wavelength. In such a case, a conventional image forming apparatus might erroneously detect a density of a toner pattern and be unable to perform appropriate image density correction processing. Compared with this, according to the above embodiment, bare surface profile data is acquired beforehand, and detection data is corrected based on the acquired bare surface profile data. Accordingly, such a problem does not occur.

(3) In the case where a solid thin film layer is formed on the intermediate transfer belt 21 such as the above, it is possible to employ, as a mark for detecting the home position, a portion of the solid thin film layer whose thickness has been partially changed with use of the general optical properties.

The following provides a specific description. When light is irradiated onto the solid thin film layer, first reflected light that reflects on a surface of the solid thin film layer and second reflected light that enters in the solid thin film layer and reflects on an interface between the solid film layer and the intermediate transfer belt 21. Depending on the difference in light path distance between the first and second reflected light, an optical interference occurs between the first and second reflected light, and as a result reflected light of a particular wavelength decreases.

This difference in light path distance is determined based on the thickness and a refractive index of the solid thin film layer and an incident angle of a beam of light. Accordingly, by mainly changing the thickness of the solid thin film layer with respect to a beam of light of a particular wavelength λ, it is possible to vary the intensity of reflected light of the beam of light.

The relationship between the reflectivity R to the incident light of the wavelength λ, and the thickness d of the thin film layer is represented as a reflectance function R(d), which is known as showing a wave shape having a periodicity.

Figure 16:
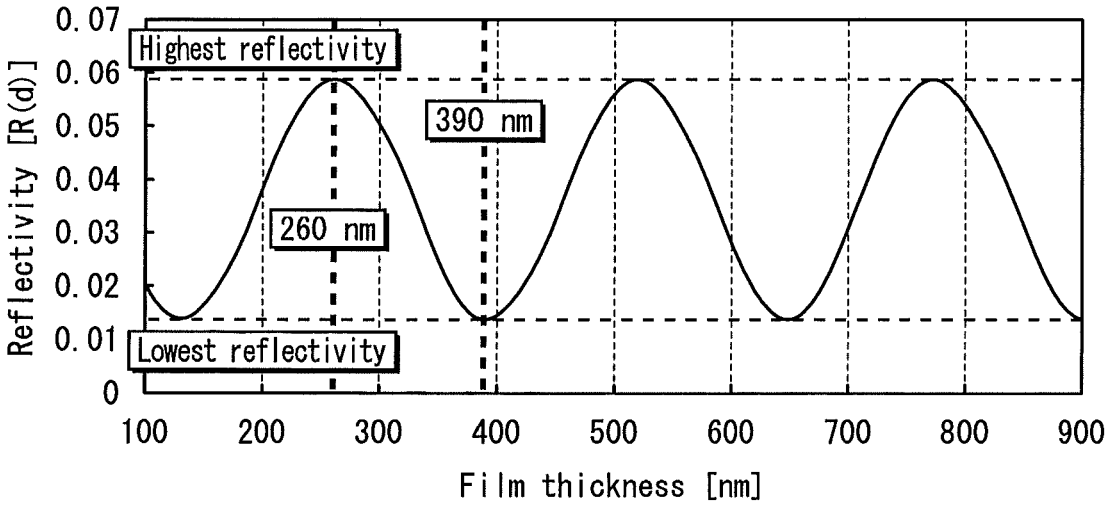
FIG. 16 is a graph showing the relationship between the thickness of the surface-hardened film and the reflectivity.

FIG. 16 shows a graph of the relationship between the thickness d [nm] of the thin film layer and the reflectivity R, in the case where the light emitting element 231 of a main light emission wavelength of 730 nm emits a beam of light toward the film layer at an incident angle of 20°.

As shown in FIG. 16, the reflectivity periodically varies depending on the increase in the thickness d of the thin film layer. In the desired range of the thickness d of the film layer (100 nm<d<500 nm), the thickness d of 260 nm corresponds to the highest reflectivity, and the thickness d of 390 nm corresponds to the lowest reflectivity.

Figure 17:
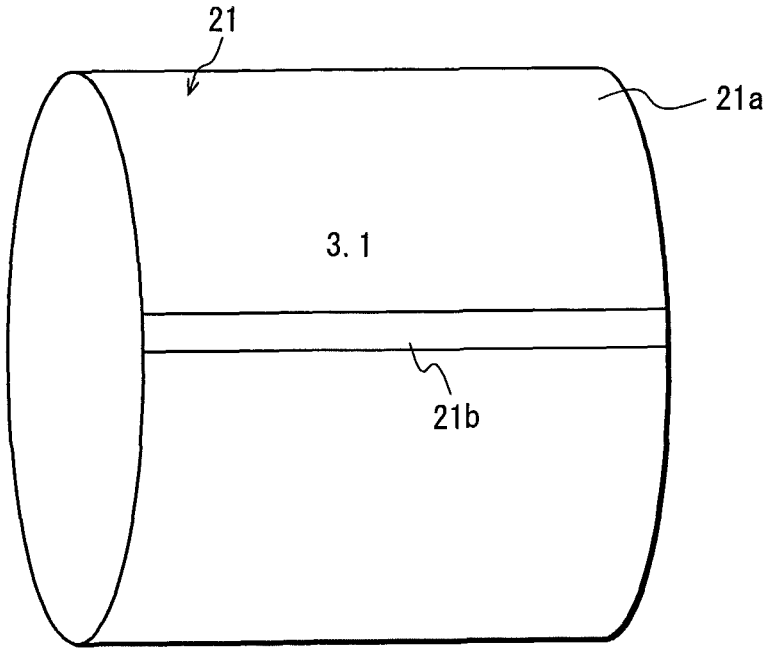
FIG. 17 schematically shows the appearance of an intermediate transfer belt in which a surface-hardened film formed on its surface has a portion whose thickness is changed for use as a mark showing a home position of the intermediate transfer belt.

FIG. 17 schematically shows an intermediate transfer belt 21 relating to the present modification example which has not been yet incorporated into the printer 1. As shown in FIG. 17, a different thickness portion 21*b* is formed by making the solid thin film layer 21*a*, which is formed on a circumferential surface of the intermediate transfer belt 21, to have an increased thickness on one portion in a circumferential direction of the intermediate transfer belt 21.

Here, based on the graph shown in FIG. 16, the solid thin film layer 21*a* is set to have the different thickness portion 21*b* with a thickness of "390 nm" and other portions with a thickness of "260 nm". This makes prominent the difference in amount of reflected light between the different thickness portion 21*b* and the other portions. Accordingly, the different thickness portion 21*b* can be used as a mark for detecting the home position.

The different thickness portion 21*b* has a sufficient width in the circumferential direction. Accordingly, it is possible to avoid that variation in amount of reflected light, which is caused by variation in thickness of the thin film layer due to manufacturing-derived scratches, is erroneously detected as the home position. In this case, when a voltage exceeding a predetermined threshold value continues for a predetermined time since start of detection of the different thickness portion 21*b* which corresponds to its width, the home position is detected in accordance with a timing of rising edge (or falling edge) of its detection signal. This can avoid erroneous detection. In the present modification example, the different thickness portion 21*b* has a width of 10 mm in the circumferential direction.

Note that when the other parts on the circumferential surface are set to be comparatively thicker than the different thickness portion 21*b*, namely, when the different thickness portion 21*b* has a thickness of 260 nm and the other parts has a thickness of 390 nm, it is also possible to detect the home position. However, in order to reduce the material costs, it is desirable to set the different thickness portion 21*b* to be thicker because of having a smaller area.

Also, the different thickness portion 21*b* and the other parts each may have any thickness as far as the thickness difference therebetween can be detected by the main light emission wavelength the light emitting element 231 of the density detection sensor 23. These thicknesses are of course not limited to the above values.

According to this modification example, it is unnecessary to perform process of forming the mark 21*a* using a paint or a seal. Also, in the case where the mark 21*a* is formed using a paint or a seal, long-time use of the intermediate transfer belt 21 might cause separation of the mark 21*a* due to abrasion for example, and make it difficult to detect the home position. However, according to this modification example, by forming the mark 21*a* with the difference in thickness of the solid film layer, such a problem does not occur.

(4) In the above embodiment, before use of the printer 1 by a user, such as before shipping and at the initial power-on after delivery, bare surface profile data is acquired in accordance with an operation performed by a worker of a manufacturer or a serviceman.

However, as the accumulated use time of the intermediate transfer belt 21 increases, many tiny scratches occur on the surface of the intermediate transfer belt 21 due to abrasion. There is a case where such scratches are unignorable. In order to address this case, it is desirable to perform processing of acquiring bare surface profile data at predetermined time intervals to update bare surface profile data.

For example, the following structure may be employed. As a parameter indicating an accumulated value of rotation time of the intermediate transfer belt 21, any one is determined among the accumulated number of rotations of the intermediate transfer belt 21, the accumulated value of time of image forming operations, and the accumulated number of printed recording sheets. When the parameter after the most recent acquisition of the bare surface profile data exceeds a threshold value specific to the parameter (in the case where the accumulated number of printed recording sheets is determined as the parameter, the threshold value is approximately 5000 for example), processing of acquiring bare surface profile data is performed.

In this case, the control unit 45 counts the parameter and stores the count in the EEPROM 455 or the like. When the accumulated value of the counts reaches a threshold value that is stored beforehand in the ROM 454, the control unit 45 controls to perform processing of acquiring bare surface profile data, and also performs processing of resetting the accumulated value.

Processing of updating bare surface profile data due to deterioration over time of the intermediate transfer belt 21 is performed sufficiently less frequently than image density correction processing. Accordingly, it is possible to reduce the downtime compared with a case where bare surface profile data is acquired each time image density correction processing is performed.

Note that when the parameter, which indicates the accumulated value of rotation time of the intermediate transfer belt 21, reaches the predetermined threshold value during execution of a print job, processing of updating bare surface profile data is desirably performed at a timing when the execution of the print job is not disturbed, such as after completion of the print job.

(5) Furthermore, since the degree of deterioration over time of the intermediate transfer belt 21 has a certain tendency, the degree of the deterioration can be estimated for use in correcting bare surface profile data.

The following provides a specific description. With the increase of the accumulated use time of the intermediate transfer belt 21, the depth (or height) of the manufacturing-derived scratches decreases due to abrasion with the photosensitive drum or the cleaning blade compared with the early use phase of the printer 1. Also, variation in noise peak in detecting the manufacturing-derived scratches becomes accordingly smaller. Also, the sensitivity of the density detection sensor 23 tends to deteriorate.

In view of this, the following structure may be employed. A table is obtained beforehand by performing an endurance experiment or the like, which indicates characteristics of variation in the bare surface profile data with respect to the parameter indicating the accumulated value of rotation time of the intermediate transfer belt 21. This table is stored in the ROM 454 or the EEPROM 455 as durability characteristics. The bare surface profile data is corrected based on the table and the parameter indicating the accumulated value of rotation time of the intermediate transfer belt 21. The density data is corrected based on the corrected bare surface profile data.

(6) Also, when an abnormal condition occurs on the surface of the intermediate transfer belt 21, bare surface profile data is desirably acquired again. When scratches occur on the surface of the intermediate transfer belt 21 during image forming operations for example, it is no longer possible to perform sufficient correction using bare surface profile data that has been early acquired. Accordingly, it is desirable to newly perform processing of acquiring bare surface profile data to update the table shown in FIG. 12.

The abnormal condition on the surface can be detected by the following method, for example. When it is impossible to adjust the output level of the density detection sensor 23 in calibration for performing image density correction within the reference voltage range (range of 3.0 V±0.1 V in the present embodiment) in the processing of acquiring bare surface profile data, image density correction processing is unlikely to be appropriately performed. Accordingly, it is judged that an abnormal condition has occurred on the surface of the intermediate transfer belt 21. Note that it is desirable that when processing of bare surface profile data is newly performed, the detection position P (FIG. 3) is changed. This is because there is a high possibility that scratches have been occurred on the detection position P.

The abnormal condition on the surface can be also detected by the following method, for example. With respect to the peak position where variation exceeding a predetermined value is detected, comparison is performed between detection data acquired in the image density correction processing (excluding a value corresponding to a portion on which the toner pattern is formed) and bare surface profile data. When the detection data of the toner pattern has a peak which the bare surface profile data does not have, it is judged that an abnormal condition has occurred on the surface of the intermediate transfer belt 21.

Even when the surface condition on the intermediate transfer belt 21 is judged to be abnormal such as the above, it is possible to precisely perform image density correction processing by again performing processing of acquiring bare surface profile data, with no need to replace the intermediate transfer belt 21 with new one. This can offer a longer operating life of the intermediate transfer belt 21 as a unit in the intermediate transfer unit 20.

(7) In the above embodiment, in order to acquire bare surface profile data, detection is performed on the bare surface of the intermediate transfer belt 21 for one turn. Alternatively, In the case where a length of an area in the circumferential direction where all the toner patterns 211, 212, 213, . . . are formed is shorter than one turn of the intermediate transfer belt 21, detection may be performed on only the area where these toner patterns are formed.

(8) In the above embodiment, the density detection sensor 23 is used also as a detection sensor for detecting the mark

21*a* showing the home position. Alternatively, it may be possible to separately provide a dedicated photoelectric sensor for detecting the home position.

(9) The number of density detection sensors 23 is not limited to one. A plurality of density detection sensors 23 may be provided in a direction perpendicular to the running direction of the intermediate transfer belt 21 (direction parallel to the main scanning direction). By forming a toner pattern at a position corresponding to each of the plurality of density sensors 23 and performing processing that is the same as that in the above embodiment, it is possible to more precisely perform image density correction processing.

(10) The above description has used the example where the developing device and the image forming apparatus relating to the present invention are applied to a tandem-type color digital printer. However, the applicable scope of the present invention is not limited to this.

The present invention is for example applicable to an image forming apparatus that includes an intermediate transfer drum as an intermediate transfer member, and rotates the intermediate transfer drum four turns to sequentially transfer toner images of C, M, Y, and K colors onto the same position on a circumferential surface thereof. This is because scratches might possibly occur on the intermediate transfer drum.

Furthermore, the present invention is applicable to a copy machine, a facsimile apparatus, an MFP (Multiple Function Peripheral), and the like, regardless of performing color or monochrome image formation.

Moreover, the above embodiment and modification examples may be combined with each other to the extent possible.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus that primarily transfers a toner image formed on an image carrier onto an intermediate transfer member, and secondarily transfers the toner image onto a recording sheet to form an image, the image forming apparatus comprising:

a sensor operable to detect intensity of light, and output a voltage in accordance with the detected intensity of light;

a detection data acquisition part operable to (i) set a plurality of reference voltages, which are each to be referred to when the sensor detects intensity of light reflected from a bare surface of the intermediate transfer member onto which a toner image has not yet been transferred, and (ii) acquire, at each set reference voltage, a voltage output by the sensor with respect to a predetermined area on the bare surface in a circumferential direction of the intermediate transfer member, as a piece of detection data;

a detection data storage operable to store therein the acquired pieces of detection data in one-to-one correspondence with the reference voltages;

a judgment part operable to judge whether to perform image density correction processing of correcting a density of a tonner image to be formed;

an output level calibration part operable, when the judgment part judges affirmatively, to adjust an output level of the sensor at the detection of the intensity of light reflected from the bare surface for calibration so as to correspond to one of the reference voltages;

a density data acquisition part operable to form a toner pattern within the predetermined area, and acquire density data of the toner pattern by causing the sensor, whose output level has been adjusted, to detect intensity of light reflected from the toner pattern;

a density data correction part operable to read, from the detection data storage, one of the pieces of detection data corresponding to the reference voltage corresponding to the adjusted output level, and correct the acquired density data based on the read piece of detection data; and an image density correction part operable to perform the image density correction processing based on the corrected density data.

2. The image forming apparatus of claim 1, wherein the piece of detection data read by the density data correction part corresponds with one of the reference voltages that is closest to the adjusted output level.

3. The image forming apparatus of claim 1, wherein the density data correction part includes an estimation subpart operable to estimate, based on two of the pieces of detection data one-to-one corresponding to first and second of the reference voltages, a piece of detection data corresponding to the adjusted output level, and the density data correction part corrects the density data based on the estimated piece of detection data.

4. The image forming apparatus of claim 3, wherein the estimation subpart (i) calculates a difference between the first reference voltage and the corresponding piece of detection data and a difference between the second reference voltage and the corresponding piece of data, (ii) obtains a correlation between reference voltage and correction coefficient based on the calculated differences, where a predetermined one of the reference voltages correlates to a correction coefficient of 1, (iii) calculates a correction coefficient based on the obtained correlation, and (iv) estimates the piece of detection data corresponding to the adjusted output level based on the piece of detection data corresponding to the predetermined reference voltage and the calculated correction coefficient.

5. The image forming apparatus of claim 1, further comprising a reception part operable to receive an instruction to detect the intensity of light reflected from the bare surface, wherein when the reception part receives the instruction, the data acquisition part acquires the pieces of detection data.

6. The image forming apparatus of claim 1, further comprising:

an accumulation part operable to accumulate an index value indicating a rotation time of the intermediate transfer member, wherein when index values accumulated since a most recent acquisition of a piece of detection data reaches a predetermined threshold value, the detection data acquisition part acquires a piece of detection data.

7. The image forming apparatus of claim 1, further comprising:

an accumulation part operable to accumulate an index value indicating a rotation time of the intermediate transfer member;

a durability characteristics storage operable to store therein a correlation between accumulated index values and change over time in output voltage of the sensor; and a detection data correction part operable to correct the piece of detection data based on the correlation stored in the durability characteristics storage with reference to the accumulated index values.

8. The image forming apparatus of claim 1, further comprising:

an abnormality detection part operable to detect an abnormal condition on a surface of the intermediate transfer member on which the toner image is carried, wherein when the abnormality detection part detects the abnormal condition, the detection data acquisition part acquires a piece of detection data.

9. The image forming apparatus of claim 1, further comprising:

a home position detection part operable to detect a home position on the intermediate transfer member; and a detection position specification part operable to specify, based on the detected home position, detection positions of the sensor on the intermediate transfer member in the circumferential direction, wherein the density data correction part corrects the density data based on a piece of detection data acquired at the same detection positions where the density data has been acquired.

10. The image forming apparatus of claim 9, wherein the home position detection part includes:

a mark for detecting the home position that is formed on a surface of the intermediate transfer member on which the toner image is carried;

a photosensitive sensor operable to detect the mark; and a counter operable to acquire a value indicating a time elapsed since the photosensitive sensor has detected the mark, and the home position detection part specifies the detection position based on the acquired value.

11. The image forming apparatus of claim 10, wherein the intermediate transfer member has a solid thin film layer formed on the surface of the intermediate transfer member, and the mark is formed by partially changing a thickness of the solid thin film layer.

12. An image density correction method for use in an image forming apparatus that primarily transfers a toner image formed on an image carrier onto an intermediate transfer member, and secondarily transfers the toner image onto a recording sheet to form an image, the image forming method comprising:

a detection data acquiring step of (i) setting a plurality of reference voltages, which are each to be referred to when a sensor detects intensity of light reflected from a bare surface of the intermediate transfer member onto which a toner image has not yet been transferred, and (ii) acquiring, at each set reference voltage, a voltage output by the sensor with respect to a predetermined area on the bare surface in a circumferential direction of the intermediate transfer member, as a piece of detection data;

a detection data storing step of storing, in a storage, the acquired pieces of detection data in one-to-one correspondence with the reference voltages;

a judging step of judging whether to perform image density correction processing of correcting a density of a tonner image to be formed;

an output level calibrating step of, when the judgment part judges affirmatively, adjusting an output level of the sensor at the detection of the intensity of light reflected from the bare surface for calibration so as to correspond to one of the reference voltages;

a density data acquiring step of forming a toner pattern within the predetermined area, and acquiring density data of the toner pattern by causing the sensor, whose output level has been adjusted, to detect intensity of light reflected from the toner pattern;

a density data correcting step of reading, from the detection data storage, one of the pieces of detection data corresponding to the reference voltage corresponding to the adjusted output level, and correcting the acquired density data based on the read piece of detection data; and an image density correcting step of performing the image density correction processing based on the corrected density data.

13. The image density correction method of claim 12, wherein the piece of detection data read in the density data correcting step corresponds to one of the reference voltages that is closest to the adjusted output level.

14. The image density correction method of claim 12, wherein the density data correcting step includes an estimating step of estimating, based on two of the pieces of detection data one-to-one corresponding to first and second of the reference voltages, a piece of detection data corresponding to the adjusted output level, and the density data correcting step corrects the density data based on the estimated piece of detection data.

15. The image density correction method of claim 12, further comprising a receiving step of receiving an instruction to detect the intensity of light reflected from the bare surface, wherein when the receiving step receives the instruction, the data acquiring step acquires the pieces of detection data.

16. The image density correction method of claim 12, further comprising:

an accumulating step of accumulating an index value indicating a rotation time of the intermediate transfer member, wherein when index values accumulated since a most recent acquisition of a piece of detection data reaches a predetermined threshold value, the detection data acquiring step acquires a piece of detection data.

17. The image density correction method of claim 12, further comprising:

an accumulating step of accumulating an index value indicating a rotation time of the intermediate transfer member;

a durability characteristics storing step of storing a correlation between accumulated index values and change over time in output voltage of the sensor; and a detection data correcting step of correcting the piece of detection data based on the stored correlation with reference to the accumulated index values.

18. The image density correction method of claim 12, further comprising:

an abnormality detecting step of detecting an abnormal condition on a surface of the intermediate transfer member on which the toner image is carried, wherein when the abnormality detecting step detects the abnormal condition, the detection data acquiring step acquires a piece of detection data.

19. The image density correction method of claim 12, further comprising:

a home position detecting step of detecting a home position on the intermediate transfer member; and a detection position specifying step of specifying, based on the detected home position, detection positions of the sensor on the intermediate transfer member in the circumferential direction, wherein the density data correction step corrects the density data based on a piece of detection data acquired at the same detection positions where the density data has been acquired.

* * * * *